United States Patent [19]

Shimiya et al.

[11] 4,090,085

[45] May 16, 1978

[54] INTENSIFYING SCREEN FOR RADIOGRAPHS

[75] Inventors: Keiji Shimiya, Hiratsuka; Norio Miura, Isehara; Masao Takano; Kunio Ishigaki, both of Minami-ashigara, all of Japan

[73] Assignees: Dai Nippon Toryo Co., Ltd., Osaka; Fuji Photo Film Co., Ltd., Minami-ashigara, both of Japan

[21] Appl. No.: 716,369

[22] Filed: Aug. 23, 1976

[30] Foreign Application Priority Data

Aug. 28, 1975 Japan ..... 50-104258

[51] Int. Cl.[2] ..... H01J 1/62

[52] U.S. Cl. ..... 250/483; 250/487

[58] Field of Search ..... 250/483, 487

[56] References Cited

U.S. PATENT DOCUMENTS

| | | | |
|---|---|---|---|
| 2,616,057 | 10/1952 | Coltman | 250/487 X |
| 3,043,710 | 7/1962 | Patten et al. | 250/487 X |
| 3,783,297 | 1/1974 | Houston | 250/483 |
| 3,962,582 | 6/1976 | Greschat et al. | 250/483 |

*Primary Examiner*—Archie R. Borchelt

*Attorney, Agent, or Firm*—Gerald J. Ferguson, Jr.; Joseph J. Baker

[57] ABSTRACT

In an intensifying screen composed of a support layer, a phosphor layer and a protective layer or of a support layer, a reflective layer, a phosphor layer and a protective layer, a carbon black layer is interposed between the support layer and the phosphor layer or the reflective layer. Further, antistatic agents are mingled in the protective layer.

10 Claims, 2 Drawing Figures

INTENSIFYING SCREEN FOR RADIOGRAPHS

BACKGROUND OF THE INVENTION

1. Field of the Invention

This invention relates to an intensifying screen for radiographs, and more particularly to an intensifying screen for radiographs used in contact with a radiographic film in which the film is exposed to radiations of X-ray, γ-ray or the like.

2. Description of the Prior Art

In radiographs, radiographic film is usually sandwiched between a pair of intensifying screens while the film is exposed to radiation. The radiations are visualized by the phosphor layer of the intensifying screens on both surfaces of the film so that images are recorded on the film with high optical density.

The intensifying screens are usually comprised of a support layer having a thickness of 0.2 to 0.5mm of a resinous sheet material such as polyester resin, polystyrene resin or the like or a support layer of synthetic paper, and a phosphor layer carried thereon. Further, some intensifying screens have a protective layer having a thickness of about 10μ applied on the phosphor layer.

As for the phosphor layer, fluorescent materials are usually employed and dispersed in a binder of high polymer such as nitrocellulose or polymethacrylic resins. As for the fluorescent materials, the following phosphors may be employed: self-activated calcium tungstate ($CaWO_4$), silver activated zinc sulfide (ZnS:Ag), lead activated barium sulfate ($BaSO_4$:Pb), rare earth activated rare earth oxysulfide (e.g. $Gd_2O_2S$:Tb), rare earth activated rare earth oxyhalide (e.g. LaOBr:Tb), or the like. As for the protective layer, cellulose acetate, polymethylmethacrylate film or the like may be used.

When radiographic film is used, the film is put in a cassette together with a pair of intensifying screens which sandwich the film therein. In the cassette, the intensifying screens are in face contact with both surfaces of the radiographic film. When the film and the intensifying screens are taken out of the cassette, electrostatic discharge sometimes occurs between the film and the intensifying screens. The electrostatic discharge causes the film to be stained with static marks and lowers the image quality of the radiograph. When the support layer of the intensifying screens is made of a plastic material such as polyester or polystyrene, the electrostatic discharging is particularly apt to occur.

In order to prevent the electrostatic discharging, it has been known in the art, to mingle an antistatic agent in the phosphor layer of the intensifying screen, as disclosed in Japanese Patent Publication No. 3295/1966. It has also been known to provide an antistatic coating on the support layer of the intensifying screen before applying the phosphor layer thereon, as disclosed in Japanese Patent Publication No. 3296/1966.

SUMMARY OF THE INVENTION

The object of the present invention is to provide an intensifying screen for radiographs which effectively prevents the occurrence of electrostatic discharging between the radiographic film and the intensifying screens and ensures the formation of a sharp image and its unhindered visibility on the radiographic film.

The intensifying screen in the present invention is characterized by a carbon black layer interposed between the support layer and the phosphor layer (or between the support layer and the reflective layer, in the type which has a reflective layer between the support layer and the phosphor layer), and an antistatic agent added to the protective layer of the phosphor layer.

In accordance with the intensifying screen of the present invention, the protective layer containing the antistatic agent prevents the screen from being electrostatically charged and the carbon black layer absorbs light to enhance the sharpness of the image recorded on the film.

DESCRIPTION OF THE PREFERRED EMBODIMENTS

Figure 1:
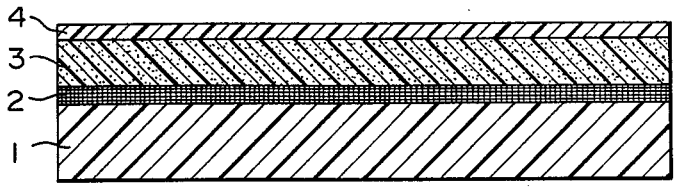
FIG. 1 is a cross-sectional view of an intensifying screen in accordance with an embodiment of the present invention.

One embodiment of the intensifying screen in accordance with the present invention is shown in FIG. 1. The intensifying screen of the type as shown in FIG. 1 has a high sharpness of image. Referring to FIG. 1, a carbon black layer 2 is interposed between a support layer 1 and a phosphor layer 3. On the phosphor layer 3 is superimposed a protective layer 4.

The support layer 1 and the phosphor layer 3 can be made of the same material as that used in conventional intensifying screens, and accordingly, a detailed description thereof is omitted here.

The carbon black layer 2 has a thickness of 0.005–0.05mm. The carbon black which constitutes the carbon black layer 2 applied on the support layer 1 is made by solving one weight part of carbon black and one to two weight parts of binder resin such as polyurethane or polyester resin in a mixed solvent of methylethylketone and toluene, and dispersing the carbon black in the solvent for 10 hours by use of a ball mill. The carbon black thus prepared is applied on the support layer 1 by use of a roll coater.

The protective layer 4 is comprised of a cellulose acetate or polymethylmethacrylate film and 0.05–0.5% of surface active agents added thereto. The thickness of the protective layer 4 is about 10μ. The surface active agent is added to the film as an antistatic agent. The surface active agent is preferred to be soluble in the resin of the protective layer and be transparent to the fluorescent light from the phosphor layer 3. From this viewpoint, anionic surface active agents of alkylphosphoric acid ester salt such as "Electrostripper-N" (made by KAO-ATLAS Co., Ltd.), or cationic surface active agents of quaternary ammonium compound such as "Quatamin sanisol" (made by KAO-ATLAS Co., Ltd.) may be used as the surface active agent.

Figure 2:
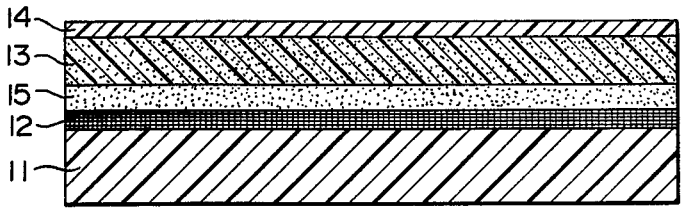
FIG. 2 is a cross-sectional view an intensifying screen in accordance with another embodiment of the present invention.

Another embodiment of the intensifying screen in accordance with the present invention is shown in FIG. 2. The intensifying screen of the type as shown in FIG. 2 has a high photographic sensitivity. Referring to FIG. 2, a reflective layer 15 is interposed between a carbon black layer 12 equivalent to said carbon black layer 2 of the first embodiment as shown in FIG. 1 and a phosphor layer 13 equivalent to said phosphor layer 3 of the first embodiment. The carbon black layer 12 is provided on a support layer 11 which is equivalent to said support layer 1 of the first embodiment. A protective layer 14 equivalent to said protective layer 4 of the first embodiment is superimposed on the phosphor layer 13. The reflective layer 15 serves to reflect fluorescent light from the phosphor layer 13 to the surface of the protective layer 14 to increase the amount of light acting on the radiographic film held in contact with the intensifying screen. The material for the reflective layer may be the same as the employed in the reflective layer of conventional intensifying screens as disclosed in U.S. Pat. No. 3,043,710.

In accordance with the intensifying screen of the present invention, the surface of the intensifying screen is prevented from being electrostatically charged by the surface active agent contained in the protective layer 4, 14, and electrostatic charges carried by the intensifying screen effectively leak through the carbon black layer 3, 13. Further, the carbon black layer 2, 12 absorbs light to enhance the sharpness of the image recorded on the film. Thus, the electrostatic discharging is effectively prevented and the deterioration of image quality is markedly reduced.

Now the present invention will be described in detail with reference to several examples thereof.

EXAMPLE I 0.75 weight part of carbon black was mixed with one weight part of a polyurethane resin binder dispersed in a mixed solvent of methylethylketone and toluene. The carbon black and the resin binder were further mixed for 10 hours by use of a ball mill. Then, the mixture was applied to a support layer of polyethylene terephthalate by means of a roll coater in a thickness of 0.02mm, after having dried. On the carbon black layer thus prepared, a terbium activated gadolinium oxysulfide phosphor dispersed in a resin binder in the ratio of 8:1 was applied in a thickness of 100mg/cm$^2$, dried, by use of a roll coater. The resin binder was prepared by solving a nitrocellulose resin in a mixed solvent of buthyl acetate, ethyl acetate and acetone. Further, on the phosphor layer applied on the carbon black layer, a protective layer was applied in the thickness of 10$\mu$, dried. The protective layer was made by solving a cellulose acetate in acetone and adding thereto an antistatic agent "Electrostripper-N" in the ratio of (0.001:1 with respect to the cellulose acetate.

The intensifying screen prepared as described above was compared with conventional intensifying screens without a carbon layer and/or without an antistatic agent in the protective layer thereof. The results of the comparison tests were shown in Table I.

Table I

| Carbon Black Layer | Antistatic Agent in Protective Layer | Surface Resistance | Rate of Leakage of Electrostatic Charges: Relative Charging Rate | Rate of Leakage of Electrostatic Charges: Half-Decay Period |
|---|---|---|---|---|
| None | None | $7.2\times10^{13}\Omega/\square$ | 100 | 19 sec |
| Exist | None | $6.5\times10^{13}$ | 16 | 3 |
| None | Exist | $5.5\times10^{11}$ | 28 | 11 |
| Exist | Exist | $6.9\times10^{10}$ | 19 | 1 |

As shown in Table I, the rate of leakage of electrostatic charges of the intensifying screens which have a carbon black layer is markedly higher than that of the intensifying screens which do not have a carbon black layer. Further, the half-decay period of the charges carried by the intensifying screens of the present invention which contain antistatic agents in the protective layer, is shorter than that of the charges carried by the intensifying screens which do not contain the antistatic agents in the protective layer. The half-decay period was determined by measuring the rate of leakage of the charges carried by the intensifying screens which were charged by a positive potential of 10000 volts.

EXAMPLE II

A carbon black layer was applied on one surface of a polyethylene terephthalate sheet having a thickness of 0.25mm in the same manner as that employed in Example I. A light reflective layer of titanium oxide having a thickness of 0.02mm was applied on the carbon black layer. A phosphor layer and a protective layer were superimposed on the light reflective layer in the same manner employed in Example I. The tests to measure the rate of leakage of the charges gave similar results to those of Example I.

We claim:

1. An intensifying screen for radiographs comprising a support layer, a phosphor layer carried on said support layer and a protective layer applied on said phosphor layer, wherein the improvement comprising a carbon black layer interposed between said support layer and said phosphor layer, and antistatic agents mingled in said protective layer, said carbon black layer absorbing light generated in said phosphor layer to enhance image definition and assisting the antistatic agent containing protective layer to discharge static charge which tends to form on said protective layer.

2. An intensifying screen for radiographs as defined in claim 1 wherein said carbon black layer has a thickness of 0.005 to 0.05mm.

3. An intensifying screen for radiographs as defined in claim 1 wherein said carbon black layer is comprised of carbon black and binder resin mixed in the ratio of 1:1 or 1:2 by weight.

4. An intensifying screen for radiographs as defined in claim 1 wherein said antistatic agents are surface active agents, the mixing ratio thereof with respect to a protective film constituting the protective layer being from 0.0005 to 0.005.

5. An intensifying screeen for radiographs as defined in claim 1 wherein said protective layer has a thickness of about 10 microns.

6. An intensifying screen for radiographs comprising a support layer, a reflective layer carried on said support layer, a phosphor layer carried on said reflective layer, and a protective layer applied on said phosphor layer, wherein the improvement comprising a carbon black layer interposed between said support layer and said reflective layer, and antistatic agents mingled in said protective layer, said reflective layer reflecting light generated in said phosphor layer and said carbon black layer assisting the antistatic agent containing protective layer to discharge static charge which tends to form on said protective layer.

7. An intensifying screen for radiographs as defined in claim 6 wherein said carbon black layer has a thickness of 0.005 to 0.05mm.

8. An intensifying screen for radiographs as defined in claim 6 wherein said carbon black layer is comprised of carbon black and binder resin mixed in the ratio of 1:1 or 1:2 by weight.

9. An intensifying screen for radiographs as defined in claim 6 wherein said antistatic agents are surface active agents, the mixing ratio thereof with respect to a protective film constituting the protective layer being from 0.0005 to 0.005.

10. An intensifying screen for radiographs as defined in claim 6 wherein said protective layer has a thickness of about 10 microns.

* * * * *